US006085851A

United States Patent [19]

Scott et al.

[11] Patent Number: 6,085,851

[45] Date of Patent: Jul. 11, 2000

[54] MULTI-ACTIVITY OFFSHORE EXPLORATION AND/OR DEVELOPMENT DRILL METHOD AND APPARATUS

[75] Inventors: Robert J. Scott, Sugarland; Robert P. Herrmann; Donald R. Ray, both of Houston, all of Tex.

[73] Assignee: Transocean Offshore Inc.

[21] Appl. No.: 08/642,417

[22] Filed: May 3, 1996

[51] Int. Cl.[7] ..... E21B 15/02; B63B 35/44

[52] U.S. Cl. ..... 175/7; 405/195.1

[58] Field of Search ..... 175/5, 6, 7, 8, 175/9; 405/195.1, 224, 223.1

[56] References Cited

U.S. PATENT DOCUMENTS

| | | | |
|---|---|---|---|
| Re. 29,373 | 8/1977 | Bsochen, Jr. | 114/293 |
| 2,503,516 | 4/1950 | Shrewsbury | 405/203 X |
| 2,808,229 | 10/1957 | Bauer et al. | 175/7 |
| 3,191,201 | 6/1965 | Richardson et al | 441/3 |
| 3,279,404 | 10/1966 | Richardson | 114/293 |
| 3,412,981 | 11/1968 | Richardson | 254/106 |
| 3,461,828 | 8/1969 | Bielstein | 114/265 |
| 3,552,343 | 1/1971 | Scott | 114/293 |
| 3,601,075 | 8/1971 | Desllerres | 114/293 |
| 3,602,302 | 8/1971 | Kluth | 166/336 |
| 3,628,336 | 12/1971 | Moore et al. | 405/196 |
| 3,682,242 | 8/1972 | Brooks et al. | 166/336 |
| 3,739,736 | 6/1973 | Carreau et al. | 114/293 |
| 3,774,562 | 11/1973 | Dean, III | 114/293 |
| 3,822,663 | 7/1974 | Boschen, Jr. | 114/293 |
| 3,828,561 | 8/1974 | Moore et al. | 405/197 |
| 3,880,105 | 4/1975 | Bryant | 114/294 |
| 4,108,255 | 8/1978 | Smith | 175/9 |
| 4,227,831 | 10/1980 | Evans | 405/196 |
| 4,351,258 | 9/1982 | Ray et al. | 114/230 |
| 4,446,807 | 5/1984 | Johnson et al. | 114/230 |
| 4,457,250 | 7/1984 | Oshima et al. | 114/265 |
| 4,470,468 | 9/1984 | Phares | 175/7 |
| 4,509,448 | 4/1985 | Pease et al. | 114/293 |
| 4,519,728 | 5/1985 | Oshima et al. | 405/224 |
| 4,571,125 | 2/1986 | Oshima et al. | 405/224 |
| 4,601,252 | 7/1986 | Wuttudal | 114/230 |
| 4,604,961 | 8/1986 | Ortloff et al. | 114/230 |
| 4,819,730 | 4/1989 | Williford et al. | 166/355 |
| 5,381,750 | 1/1995 | Pollack | 114/230 |

FOREIGN PATENT DOCUMENTS

| | | |
|---|---|---|
| 1379830 | 10/1964 | France . |
| 2381166 | 10/1978 | France . |
| 2670742 | 6/1992 | France . |
| 1917451 | 11/1969 | Germany . |
| 2345167 | 4/1974 | Germany . |
| 60146787 | 8/1985 | Japan . |
| 6280196 | 4/1987 | Japan . |
| 8802980 | 12/1988 | Netherlands . |
| 1494720 | 7/1975 | United Kingdom . |
| 1540544 | 4/1976 | United Kingdom . |
| 2071734 | 3/1980 | United Kingdom . |
| 2066758 | 7/1981 | United Kingdom . |
| 2160166 | 12/1985 | United Kingdom . |
| 2291664 | 7/1994 | United Kingdom . |
| 8707674 | 6/1986 | WIPO . |
| 8808806 | 11/1988 | WIPO . |

OTHER PUBLICATIONS

Baldt Incorporated —"Anchor/Mooring Systems for Drilling Rigs", 1978.

Preliminary Proposal From Smedvig Dual Operation Drilling, Feb. 1996.

Technical Description From GVA Twindriller, Jul. 15, 1985 (Only Cover Page Available to Applicant).

*Primary Examiner*—David J Bagnell
*Attorney, Agent, or Firm*—Bradford Kile

[57] ABSTRACT

A multi-activity driliship, or the like, method and apparatus having a single derrick and multiple tubular activity stations within the derrick wherein primary drilling activity may be conducted from the derrick and simultaneously auxiliary drilling activity may be conducted from the same derrick to reduce the length of the primary drilling activity critical path.

13 Claims, 8 Drawing Sheets

MULTI-ACTIVITY OFFSHORE EXPLORATION AND/OR DEVELOPMENT DRILL METHOD AND APPARATUS

BACKGROUND OF THE INVENTION

This invention relates to a novel method and apparatus for offshore drilling operations. More specifically, this invention relates to a method and apparatus for conducting exploration drilling offshore, with a single derrick wherein primary and auxiliary exploration drilling operations may be performed simultaneously to shorten the critical path of primary drilling activity. In addition, this invention relates to a method and apparatus wherein a single derrick is operable to perform multiple drilling, development, and work over operations simultaneously.

In the past, substantial oil and gas reserves have been located beneath the Gulf of Mexico, the North Sea, the Beaufort Sea, the Far East regions of the world, the Middle East, West Africa, etc. In the initial stages of offshore exploration and/or development drilling, operations were conducted in relatively shallow water of a few feet to a hundred feet or so along the near shore regions and portions of the Gulf of Mexico. Over the years, the Gulf and other regions of the world have been extensively explored and known oil and gas reserves in shallow water have been identified and drilled. As the need for cost effective energy continues to increase throughout the world, additional reserves of oil and gas have been sought in water depths of three to five thousand feet or more on the continental shelf. As an example, one actively producing field currently exists off the coast of Louisiana in two thousand eight hundred feet of water and drilling operations off New Orleans are envisioned in the near future in approximately three thousand to seven thousand five hundred feet of water. Still further, blocks have been leased in fields of ten thousand feet and by the year 2000 it is anticipated that a desire will exist for drilling in twelve thousand feet of water or more.

Deep water exploration stems not only from an increasing need to locate new reserves, as a general proposition, but with the evolution of sophisticated three dimensional seismic imaging and an increased knowledge of the attributes of turbidities and deep water sands, it is now believed that substantial high production oil and gas reserves exist within the Gulf of Mexico and elsewhere in water depths of ten thousand feet or more.

Along the near shore regions and continental slope, oil reserves have been drilled and produced by utilizing fixed towers and mobile units such as jack-up platforms. Fixed towers or platforms are typically fabricated on shore and transported to a drilling site on a barge or self floating by utilizing buoyancy chambers within the tower legs. On station, the towers are erected and fixed to the seabed. A jack-up platform usually includes a barge or self-propelled deck which is used to float the rig to station. On site legs at the corners of the barge or self-propelled deck are jacked down into the seabed until the deck is elevated a suitable working distance above a statistical storm wave height. An example of a jack-up platform is disclosed in Richardson U.S. Pat. No. 3,412,981. A jack-up barge is depicted in U.S. Pat. No. 3,628,336 to Moore et al.

Once in position fixed towers, jack-up barges and platforms are utilized for drilling through a short riser in a manner not dramatically unlike land based operations. It will readily be appreciated that although fixed platforms and jack-up rigs are suitable in water depths of a few hundred feet or so, they are not at all useful for deep water applications.

In deeper water, a jack-up tower has been envisioned wherein a deck is used for floatation and then one or more legs are jacked down to the seabed. The foundation of these jack-up platforms can be characterized into two categories: (1) pile supported designs and (2) gravity base structures. An example of a gravity base, jack-up tower is shown in U.S. Herrmann et al. Pat. No. 4,265,568. Again, although a single leg jack-up has advantages in water depths of a few hundred feet it is still not a design suitable for deep water sites.

For deep water drilling, semi-submersible platforms have been designed, such as disclosed in U.S. Ray et al. U.S. Pat. No. 3,919,957. In addition, tension leg platforms have been used such as disclosed in U.S. Steddum U.S. Pat. No. 3,982,492. A tension leg platform includes a platform and a plurality of relatively large legs extending downwardly into the sea. Anchors are fixed to the seabed beneath each leg and a plurality of permanent mooring lines extend between the anchors and each leg. These mooring lines are tensioned to partially pull the legs against their buoyancy, into the sea to provide stability for the platform. An example of a tension leg platform is depicted in U.S. Ray et al. U.S. Pat. No. 4,281,613.

In even deeper water sites, turret moored drillships and dynamically positioned drillships have been used. Turret moored drillships are featured in Richardson et al. U.S. Pat. Nos. 3,191,201 and 3,279,404.

A dynamically positioned drillship is similar to a turret moored vessel wherein drilling operations are conducted through a large central opening or moon pool fashioned vertically through the vessel amid ships. Bow and stern thruster sets are utilized in cooperation with multiple sensors and computer controls to dynamically maintain the vessel at a desired latitude and longitude station. A dynamically positioned drillship and riser angle positioning system is disclosed in Dean U.S. Pat. No. 4,317,174.

Each of the above-referenced patented inventions are of common assignment with the subject application.

Notwithstanding extensive success in shallow to medium depth drilling, there is a renewed belief that significant energy reserves exist beneath deep water of seven thousand to twelve thousand feet or more. The challenges of drilling exploratory wells to tap such reserves, however, and follow on developmental drilling over a plurality of such wells are formidable. In this it is believed that methods and apparatus existing in the past will not be adequate to economically address the new deep water frontier.

As drilling depths double and triple, drilling efficiency must be increased and/or new techniques envisioned in order to offset the high day rates that will be necessary to operate equipment capable of addressing deep water applications. This difficulty is exacerbated for field development drilling where drilling and completion of twenty or more wells is often required. In addition, work over or remedial work such as pulling trees or tubing, acidifying the well, cementing, recompleting the well, replacing pumps, etc. in deep water can occupy a drilling rig for an extended period of time.

Accordingly, it would be desirable to provide a novel method and apparatus that would be suitable for all offshore applications but particularly suited for deep water exploration and/or developmental drilling applications that would utilize drillships, semi-submersible, tension leg platforms, and the like, with enhanced efficiency to offset inherent increases in cost attendant to deep water applications.

OBJECTS OF THE INVENTION

It is, therefore, a general object of the invention to provide a novel method and apparatus for exploration and/or field development drilling of offshore oil and gas reserves, particularly in deep water sites.

It is a specific object of the invention to provide a novel method and apparatus utilizing a multi-activity derrick for offshore exploration and/or field development drilling operations which may be utilized in deep water applications with enhanced efficiency.

It is another object of the invention to provide a novel offshore exploration and/or field development drilling method and apparatus where a single derrick can be utilized for primary, secondary and tertiary tubular activity simultaneously.

It is a related object of the invention to provide a novel offshore exploration drilling method and apparatus wherein multi-drilling activities may be simultaneously performed within a single derrick, and thus certain tubular operations are removed from a critical path of primary drilling activity.

It is a further object of the invention to provide a novel method and apparatus where multi-tubular operations may be conducted from a single derrick and primary drilling or auxiliary tubular activity may be performed simultaneously through a plurality of tubular handling locations within a single derrick.

It is yet another object of the invention to provide a novel derrick system for offshore exploration and/or field development drilling operations which may be effectively and efficiently utilized by a drillship, semi-submersible, tension leg platform, jack-up platform, fixed tower or the like, to enhance the drilling efficiency of previously known systems.

It is yet another object of the invention to provide a novel method and apparatus for deep water exploration and/or production drilling applications with enhanced reliability as well as efficiency.

It is a further object of the invention to provide a novel method and apparatus for deep water field development drilling or work over remedial activity where multiple wells may be worked on simultaneously from a single derrick.

BRIEF SUMMARY OF THE PREFERRED EMBODIMENT OF THE INVENTION

A preferred embodiment of the invention which is intended to accomplish at least some of the foregoing objects comprises a multi-activity drilling assembly which is operable to be mounted upon a deck of a drillship, semi-submersible, tension leg platform, jack-up platform, offshore tower or the like for supporting exploration and/or development drilling operations through a deck and into the bed of a body of water.

The multi-activity drilling assembly includes a derrick for simultaneously supporting exploration and/or production drilling operations and tubular or other activity auxiliary to drilling operations through a drilling deck. A first tubular station is positioned within the periphery of the derrick for conducting drilling operations through the drilling deck. A second tubular station is positioned adjacent to but spaced from the first and within the periphery of the derrick for conducting operations auxiliary to the primary drilling function.

With the above multi-activity derrick, primary drilling activity can be conducted through the first tubular station and simultaneously auxiliary drilling and/or related activity can be conducted within the same derrick through the second tubular station to effectively eliminate certain activity from the primary drilling critical path.

THE DRAWINGS

Other objects and advantages of the present invention will become apparent from the following detailed description of a preferred embodiment thereof, taken in conjunction with the accompanying drawings, wherein.

Figure 22:
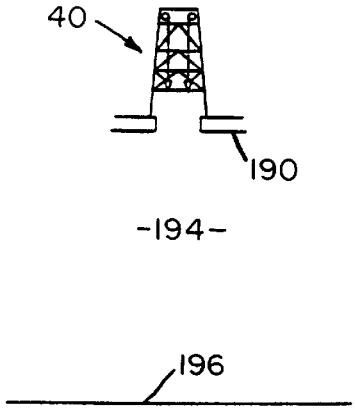
Figure 23A:
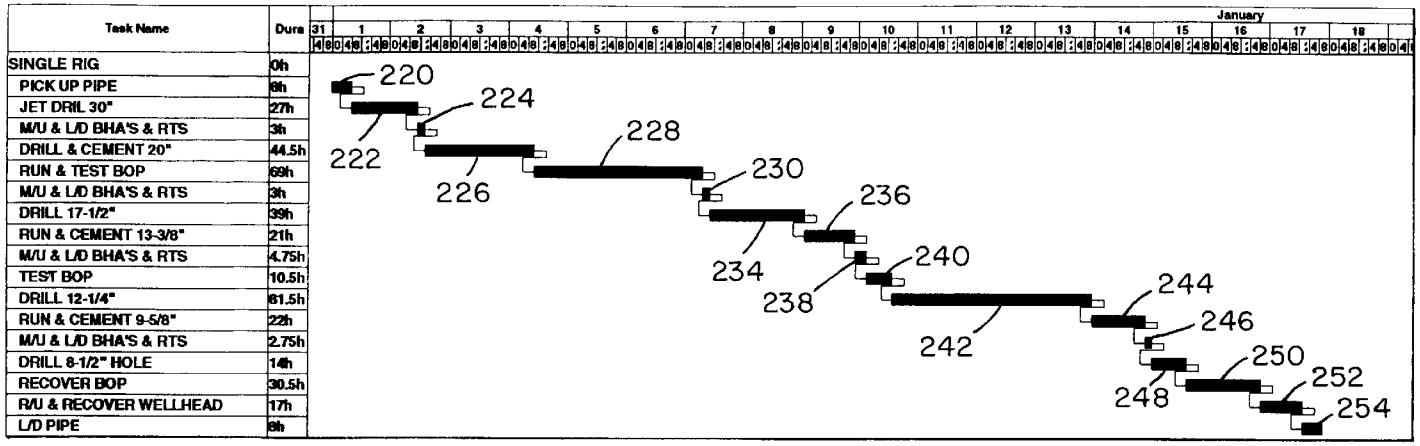
Figure 23B:
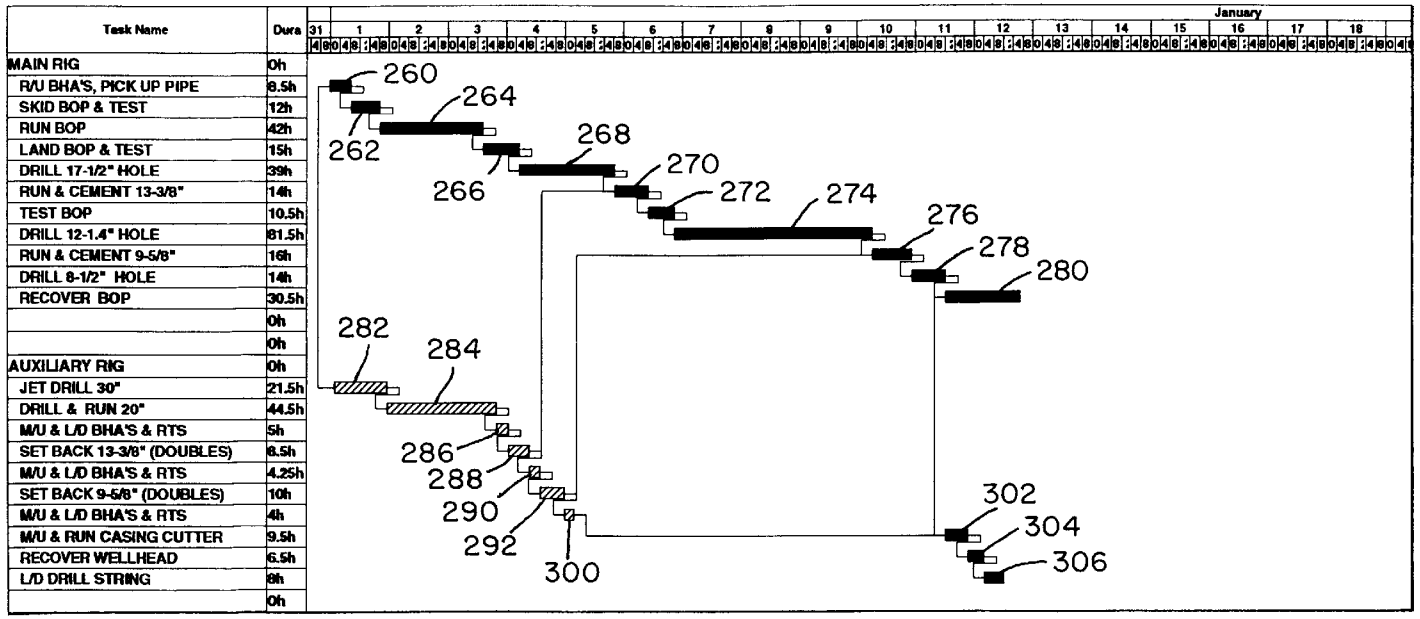

FIG. 9 through 22 depict a schematic sequence of views illustrating primary and auxiliary tubular activity being performed in accordance with one sequence of exploration drilling utilizing the subject method and apparatus; and FIGS. 23*a* and 23*b* disclose a time line for an illustrative exploratory drilling operation wherein a critical path of activity for a conventional drilling operation is depicted in FIG. 23*a* and a similar critical path time line for the same drilling activity in accordance with a method and apparatus of the subject invention, is depicted in FIG. 23*b*. FIG. 23*b* discloses a dramatic increases in exploration drilling efficiency with the subject invention.

DETAILED DESCRIPTION

Context of the Invention

Figure 1:
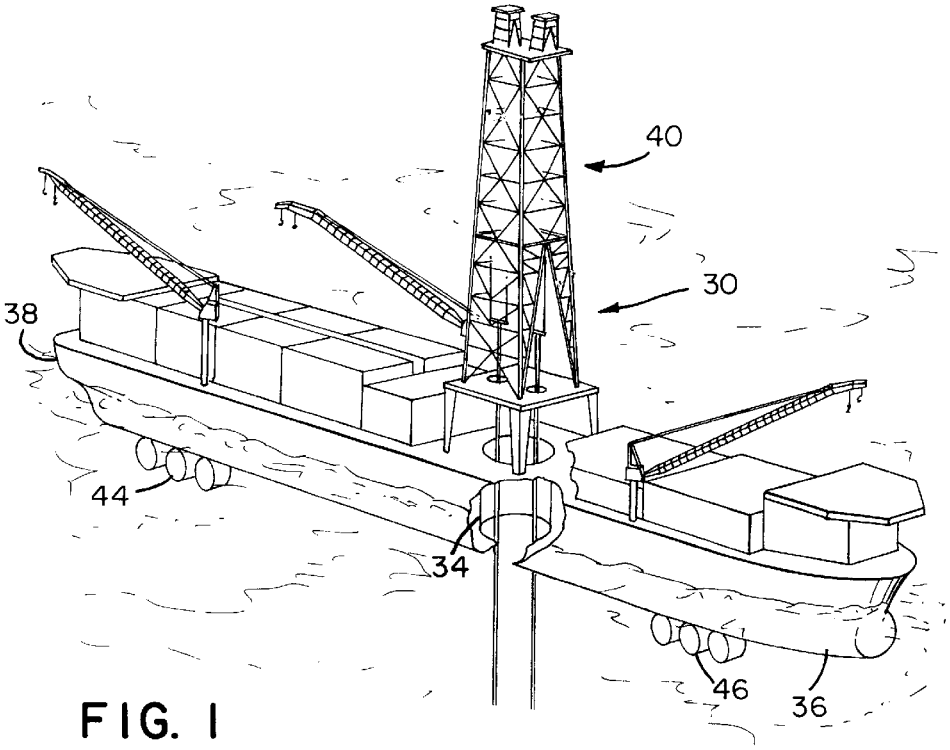
FIG. 1 is an axonometric view of a drillship of the type that is suitable to advantageously utilize the multi-activity method and apparatus of exploration and/or field development drilling in accordance with the subject invention.

Referring now to the drawings wherein, like numerals indicate like parts, and initially to FIG. 1 there will be seen an axonometric view of an offshore drillship in accordance with a preferred embodiment of the subject invention. This dynamically positioned drillship discloses the best mode of practicing the invention currently envisioned by the applicants for patent. More specifically, the subject multi-activity drillship 30 comprises a tanker-type hull 32 which is is fabricated with a large moon pool 34 between the bow 36 and stern 38. A multi-activity derrick 40 is mounted upon the drillship substructure above a moon pool 34 and operable to conduct primary tubular operations and simultaneously operations auxiliary to primary tubular operations from a single derrick through the moon pool. In this application the term tubular is used as a generic expression for conduits used in the drilling industry and includes relative large riser conduits, casing and drillstrings of various diameters.

The driliship 30 may be maintained on station by being moored, or by being turret moored such as disclosed, for example, in the above-referenced Richardson U.S. Pat. Nos. 3,191,201 and 3,279,404. In a preferred embodiment the drillship 30 is accurately maintained on station by being dynamically positioned. Dynamic positioning is performed by utilizing a plurality of bow thrusters 42 and stern thrusters 44 which are accurately controlled by computers utilizing input data to control the multiple degrees of freedom of the floating vessel in varying environmental conditions of wind, current, wave swell, etc. Dynamic positioning is relatively sophisticated and by utilizing satellite references is capable of very accurately maintaining a drillship at a desired latitude and longitude, on station, over a well-head.

Muffi-Activity Drillship

Referring now to FIGS. 1 through 4, there will be seen a plurality of views which disclose, in some detail, a multi-activity driliship in accordance with a preferred embodiment of the invention. In this, FIG. 2 discloses a starboard elevation of the multi-activity drillship which includes an aft heliport 46 above ship space 50 and a main engine room 52. Riser storage racks 54 are positioned above an auxiliary engine room 56. First 58 and second 60 pipe racks are positioned in advance of the riser storage area 54 and above an auxiliary machine room 62, warehouse and sack stores 64 and mud rooms 66. A shaker house 68 extends above the mud room 66 and adjacent to an aft portion of the multi-activity derrick 40. A first 70 and second 72 75-ton crane, with 150-foot booms, are mounted aft of the multi-activity derrick 40 and operably are utilized, for example, in connection with the riser and pipe handling requirements of the operating drillship.

Figure 2:
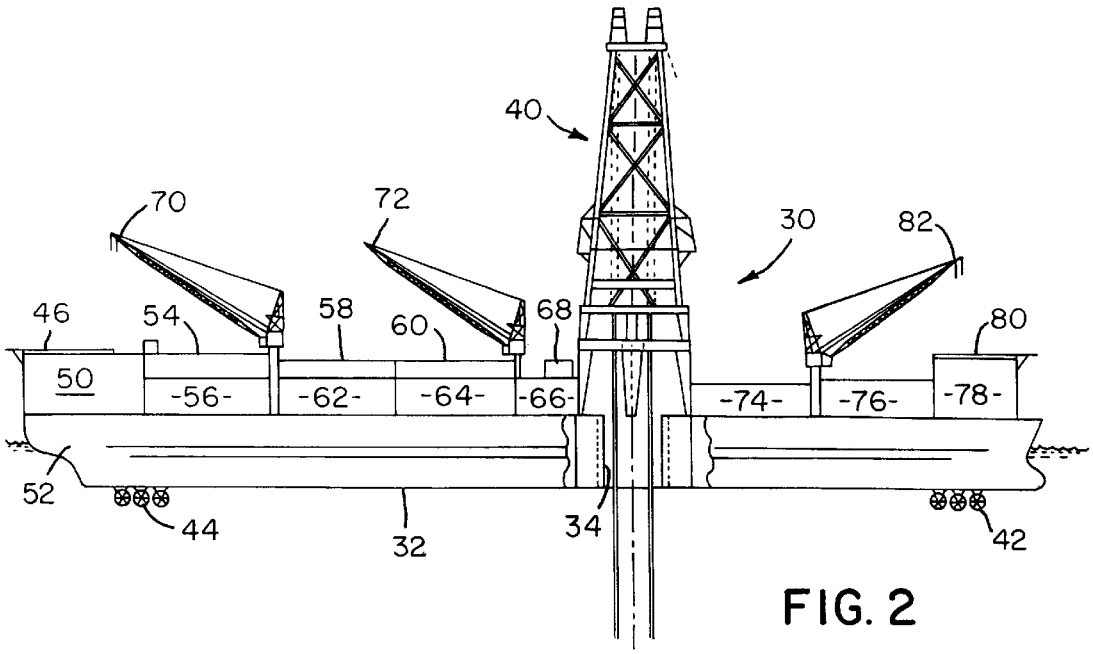
FIG. 2 is a side elevational view of the multi-activity drillship disclosed in FIG. 1 with a moon pool area broken away to disclose dual tubular strings extending from a single drilling derrick.

A machinery room and well testing area 74 is constructed adjacent to a forward edge of the multi-activity drill derrick 40 and an additional riser storage area 76 and crew quarters 78 are positioned forward of the well testing area as shown in FIG. 2. Another 75-ton crane 82, with a 150-foot boom, is positioned forward of the multi-activity derrick 40 and operably services a forward portion of the drillship.

Figure 3:
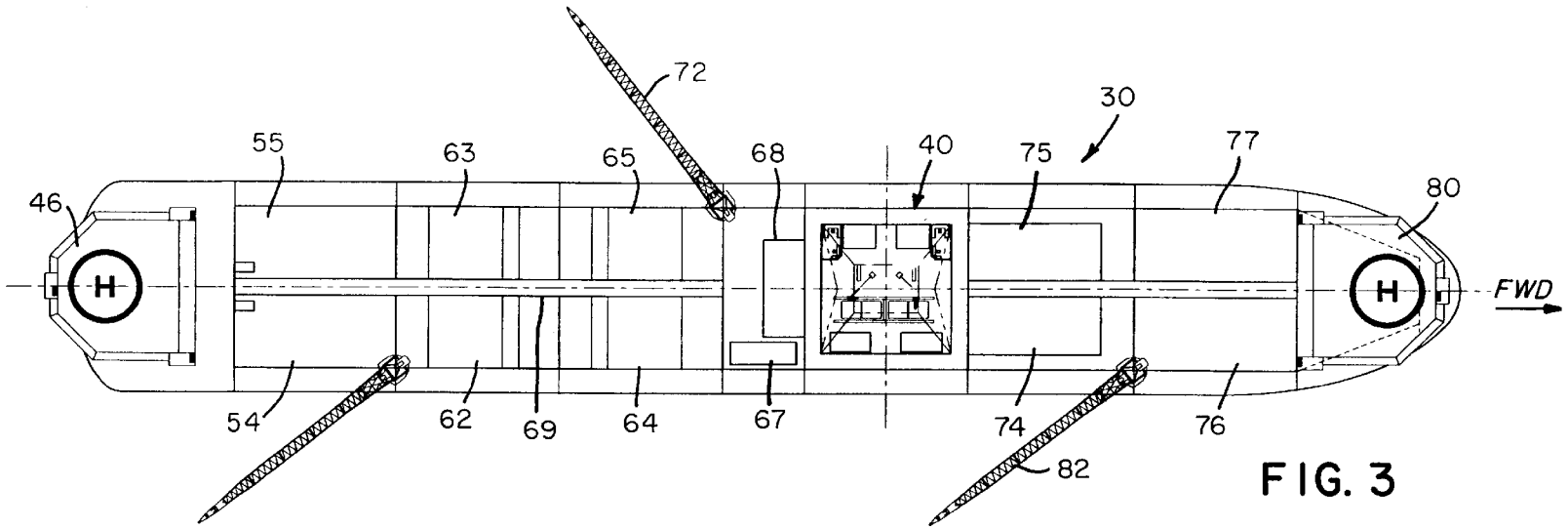
FIG. 3 is a plan view of the drillship as disclosed in FIGS. 1 and 2 which comprise a preferred embodiment of the invention.
Figure 4:
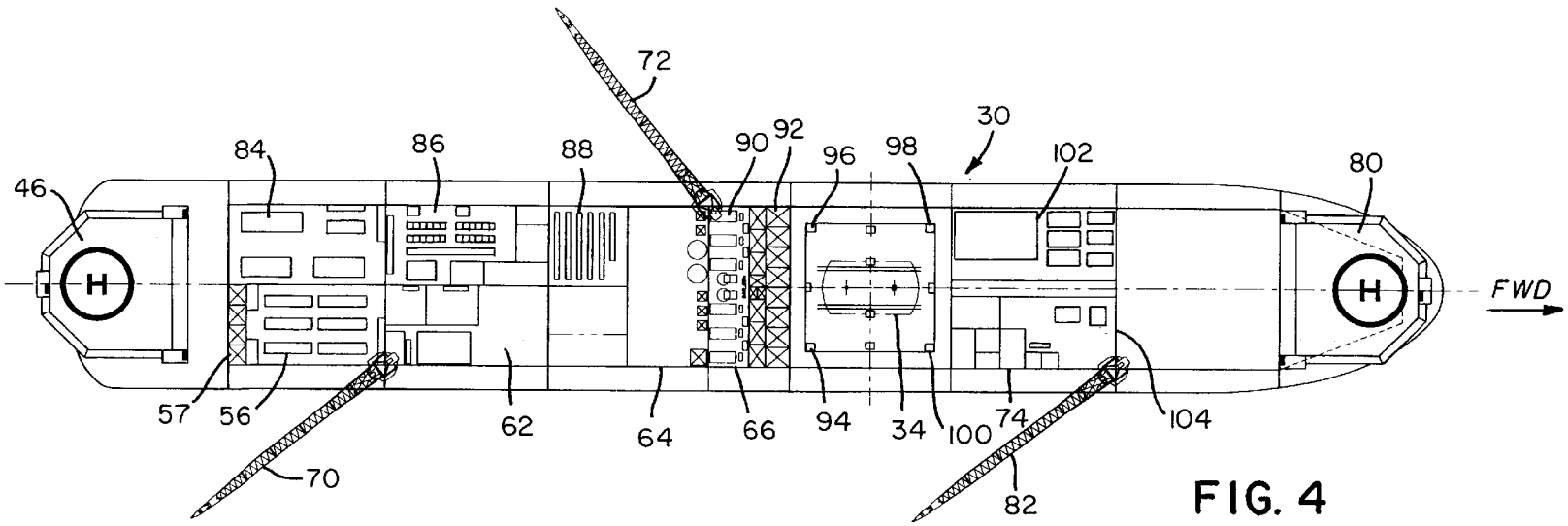
FIG. 4 is a plan view of a mechanical deck of the drillship depicted in FIG. 3 disclosing several operational features of the subject invention.

Referring to FIGS. 3 and 4, there will be seen plan views of a pipe deck and a machinery deck of a preferred embodiment of the drillship 30. Looking first at FIG. 3, and a plan view of the drillship 30, an aft heliport 46 is shown above ship space 50 and aft of a riser storage area 54. A second riser storage area 55 is positioned adjacent storage 54 and in a similar vein pipe racks 63 and 65 are positioned adjacent to previously noted pipe racks 62 and 64 respectively. The shaker house 68 is forward of the pipe racks and adjacent to the multi-activity derrick 40 and a mudlogger 67 is shown above the mud room 66. A catwalk 69 extends between the riser and pipe rack to facilitate transport of riser lengths, casing and drillpipe from the storage areas to the multi-purpose derrick 40.

A well testing area 74 and 75 is shown adjacent to the derrick 40 and aft of approximately 10,000 additional feet of tubular storage racks 76 and 77, A forward heliport 80 is shown positioned above crew quarters 78, as previously discussed, and the forward tubular area is serviced by a 75-ton crane 82 as noted above.

A plan view of the machinery deck is shown in FIG. 4 and includes an engine room 56 having fuel tanks on the starboard side and a compressed air and water maker system 84 on the port side. Auxiliary machinery 62 such as a machine shop, welding shop, and air conditioning shop are shown positioned adjacent to switching gear, control modules and SCR room 86. In front of the SCR room, in the machinery deck is an air conditioning warehouse 88 and stack stores 64 as previously noted. The mudpump rooms 66 include a plurality of substantially identical drilling mud and cement pumps 90 and mixing and storage tanks 92.

The derrick footprint 94, 96, 98, and 100 is shown in the cellar deck and is symmetrically positioned about a moon pool area 34. A parallel runway 101 extends over the moon pool and is laid between an aft subsea tree systems area and a fore subsea room area. A riser compressor room 102 is shown in a position adjacent to the forward machinery area 74 which includes a blowout preventer control area 104.

The drilling hull may be eight hundred and fifty feet in length and of a design similar to North Sea shuttle tankers. The various modularized packages of components are facilely contained within a ship of this capacity and the dynamically positioned drillship provides a large stable platform for deep water drilling operations. The foregoing multi-activity drillship and operating components are disclosed in an illustrative arrangement and it is envisioned that other equipment may be utilized and positioned in different locations, another ship design or platform designs. However, the foregoing is typical of the primary operating facilities which are intended to be included with the subject multi-activity drillship invention.

Multi-Activity Derrick

Figure 5:
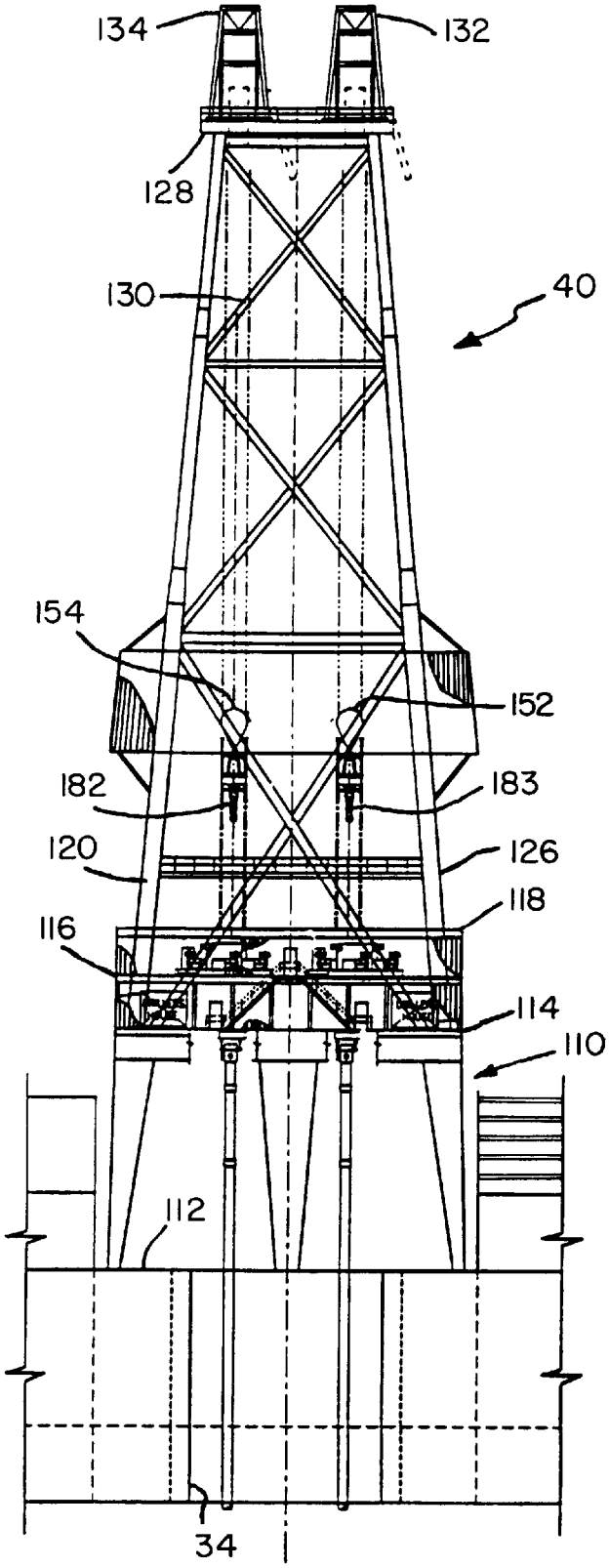
FIG. 5 is a starboard elevational view of the multi-activity drilling derrick in accordance with a preferred embodiment of the subject invention mounted upon a drillship substructure or cellar deck.
Figure 6:
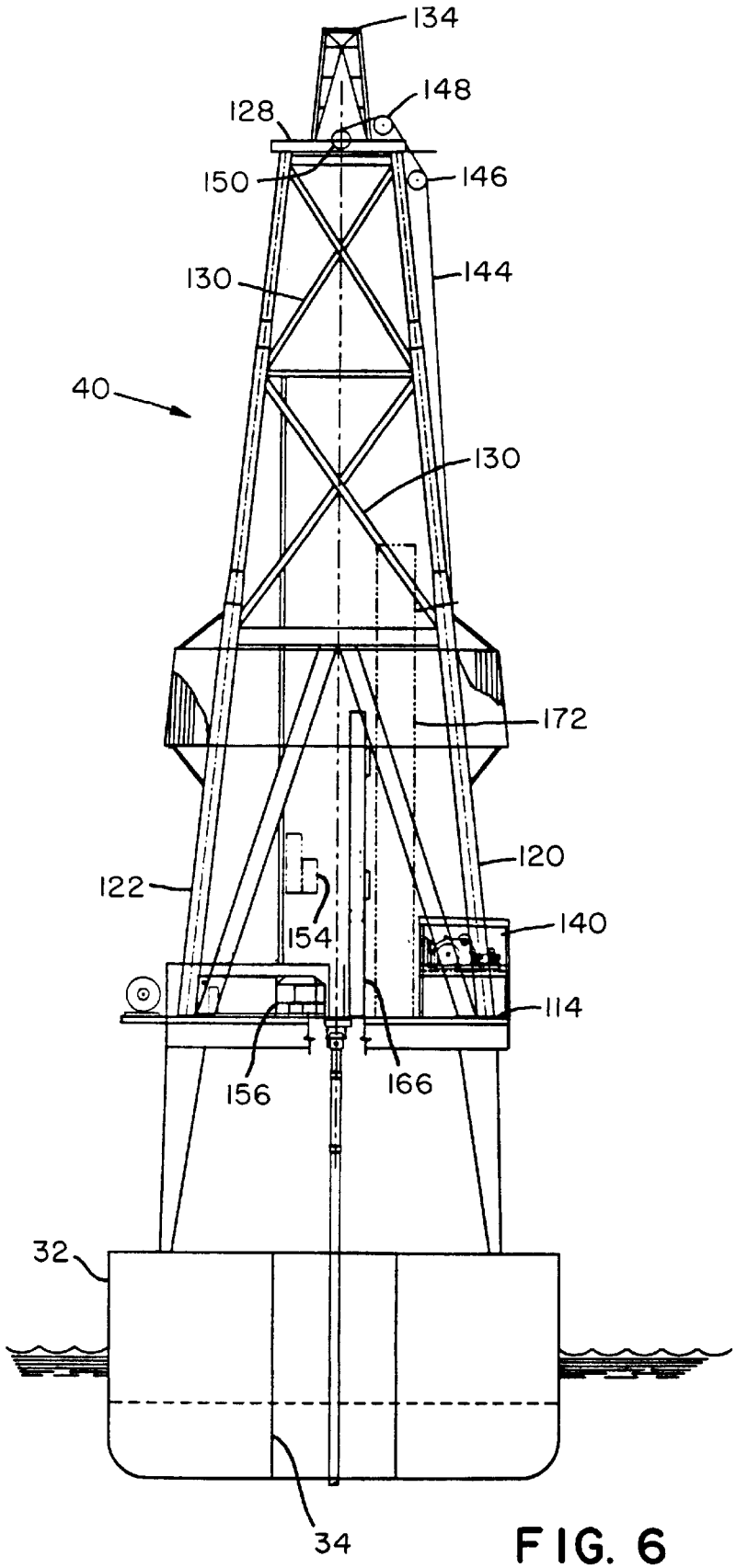
FIG. 6 is an aft elevation view of the multi-activity derrick depicted in FIG. 5.
Figure 7:
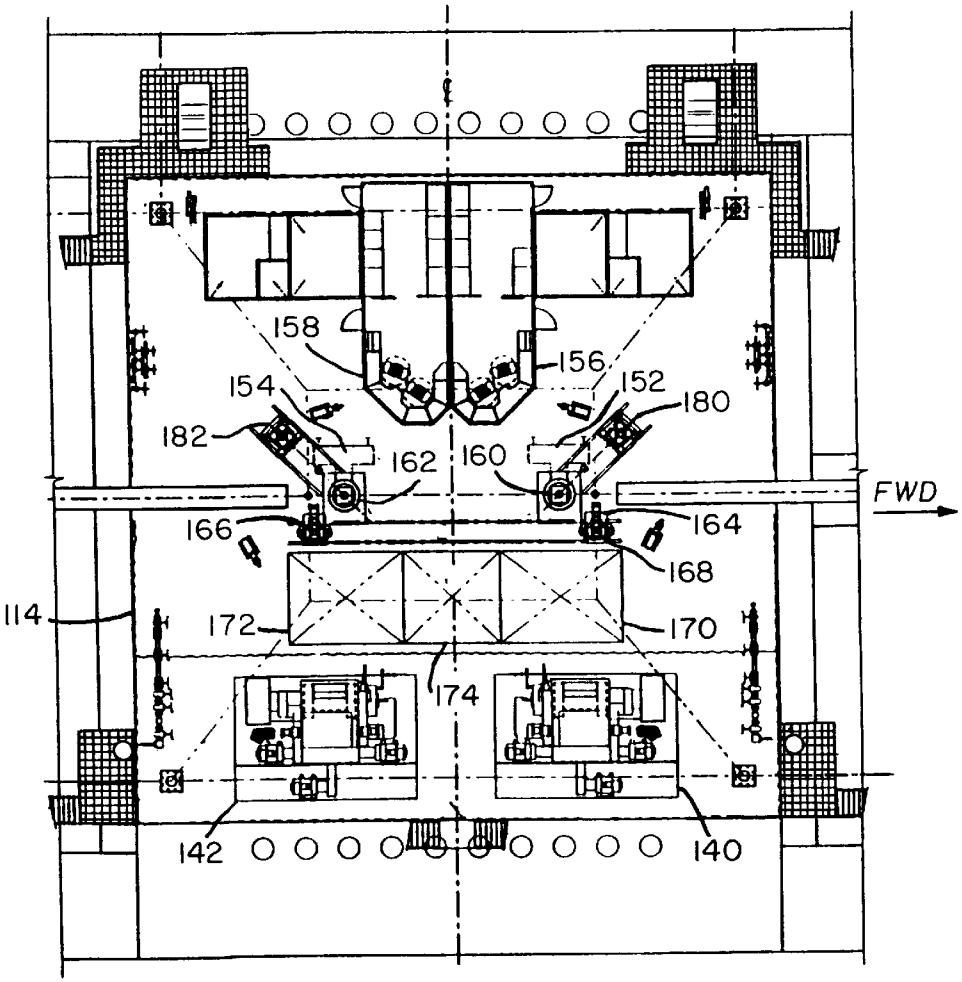
FIG. 7 is a plan view of a drilling floor for the multi-activity drilling derrick in accordance with a preferred embodiment of the invention.

Referring now to FIGS. 5 through 7, there will be seen a multi-activity derrick 40 in accordance with a preferred embodiment of the invention. The derrick 40 includes a base 110 which is joined to the drillship substructure 112 symmetrically above the moon pool 34. The base 110 is preferably square and extends upwardly to a drill floor level 114. Above the drill floor level is a drawworks platform 116 and a drawworks platform roof 118. Derrick legs 120, 122, 124, and 126 are composed of graduated tubular conduits and project upwardly and slope inwardly from the drill floor 114. The derrick terminate into a generally rectangular derrick top structure or deck 128. The legs are spatially fixed by a network of struts 130 to form a rigid drilling derrick for heavy duty tubular handling and multi-activity functions in accordance with the subject invention.

As particularly seen in FIG. 5, the derrick top 128 serves to carry a first 132 and second 134 mini-derrick which guide a sheave and hydraulic motion compensation system.

As shown in FIGS. 5 through 7, the multi-activity derrick 40 preferably includes a first 140 and second 142 drawworks of a conventional design. A cable 144 extends upwardly from the drawworks 140 over sheaves 146 and 148 and motion compensated sheaves 150 at the top of the derrick 40. The drawwork cabling extends downwardly within the derrick to first 152 and second 154 travelling blocks, note again FIG. 5. Each of the drawworks 140 and 142 is independently controlled by distinct driller consoles 156 and 158 respectively.

The foregoing described drawworks and other functionally equivalent systems, including specific structural components not yet envisioned, provide a means for hoisting tubular members for advancing and retrieving tubular members during drilling, work over or completion operations and the like.

The derrick drilling floor 114 includes, first and second tubular advancing stations 160 and 162 which in one embodiment, comprises a first rotary table and a second, substantially identical, rotary table. The rotary tables are positioned in a mutually spaced relationship, symmetrically, within the derrick 40 and, in one embodiment, along a center line of the drillship 30.

Other envisioned embodiments include rotary tables positioned from side to-side across the ship or even on a bias. The drawworks 140 is positioned adjacent to the first tubular 160 and drawworks 142 is positioned adjacent to the second tubular advanced station 162 and operably serves to conduct drilling operations and/or operations auxiliary to drilling operations through the moon pool 34 of the drillship. Each tubular advancing station includes, in one embodiment, a rotary machine, rotary drive, master bushings, kelly drive bushings and slips. In addition, each tubular advancing station 160 and 162 operably include an iron roughneck, a pipe tong, a spinning chain, a kelly and a rotary swivel for making up and tearing down tubulars in a conventional manner.

A first pipe handling apparatus 164 and a second pipe handling apparatus 166 is positioned, in one embodiment, upon a rail 168 which extends from a location adjacent to the first tubular advancing station 160 to the second tubular advancing station 162. A first conduit setback envelope 170 is located adjacent to said first pipe handling apparatus 164 and a second pipe setback envelope 172 is positioned adjacent to the second pipe handling apparatus 166. A third conduit setback envelope 174 may be positioned between the first setback envelope 170 and the second setback envelope 172 and is operable to receive conduits from either of said first conduit handling apparatus 164 or said second conduit handling apparatus 166 as they translate upon the rail 168. Positioned adjacent the first tubular advancing station 160 is a first iron roughneck 180 and a second iron roughneck 181 is positioned adjacent to the second tubular advancing station 162. The iron roughnecks are operably utilized in cooperation with the rotary stations 160 and 162, respectively to make-up and break down tubulars.

It will be seen by reference particularly to FIG. 7 that the rail 168 permits the first tubular handling assembly 164 to setback and receive conduit from any of the tubular setback envelopes 170, 172, and 174. The primary utilization for pipe handling assembly 164, however, will be with respect to setback envelope 170 and 174. In a similar manner the rail 168 permits the second tubular handling assembly 166 to transfer conduits such as riser, casing or drill pipe between the second rotary station 162 and tubular setback envelopes 172, 174, and 170, however, the tubular handling assembly 166 will be utilized most frequently with conduit setback envelopes 172 and 174. Although rail supported pipe handling systems are shown in FIG. 7, other tubular handling arrangements are contemplated by the subject invention such as a rugged overhead crane structure within the derrick 40. A common element however, among all systems will be the ability to make-up and break down tubulars at both the first and second tubular stations for advancing tubulars through the moon pool. In addition, a characteristic of tubular handling systems will be the ability to pass tubular segments back and forth between the first station for advancing tubulars through the moon pool and the second station for advancing tubulars and the setback envelopes as discussed above.

In a presently preferred embodiment, the rotary function is applied to tubulars performed by a first 182 and second 183 top drive device, note again FIG. 5. Each top drive device is similar and the unit 182 is shown more particularly in FIG. 8. The top drive is connected to traveling block 152 and is balanced by hydraulic balancing cylinders 184. A guide dolly 185 supports a power train 186 which drives a tubular handling assembly 188 above drill floor 114.

Although a rotary table system of tubular advancement and top drive have both been disclosed and discussed above, the top drive system is presently preferred. In certain instances, both systems may even be installed on a driliship. Still further, other systems may ultimately be envisioned, however, an operational characteristic of all tubular advancing systems will be the ability to independently handle, make-up or break down, set back, and advance tubulars through multi-stations over of a moon pool and into the seabed.

Figure 8:
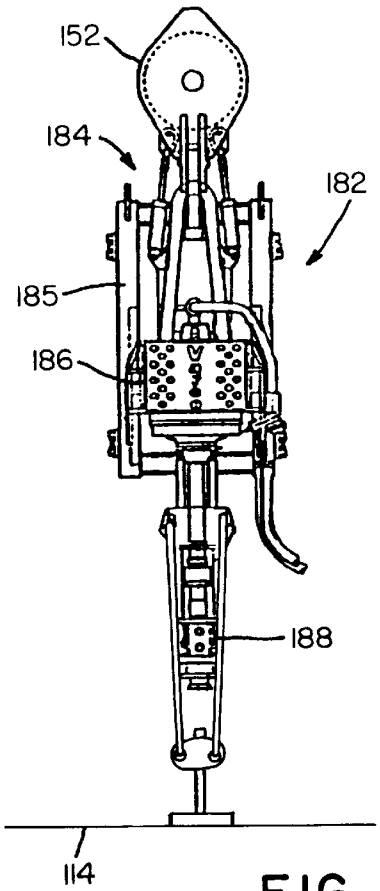
FIG. 8 is an illustrative elevation view of a top drive operable to rotate and drive tubulars in accordance with a preferred embodiment of the invention.

It will be appreciated by referring to and comparing FIGS. 5, 6, and 8 that the multi-activity derrick 40 comprises two identical top drives and/or separate rotary tables, drawworks, motion compensation and travelling blocks positioned within a single, multi-purpose derrick. Accordingly, the subject invention enables primary drilling activity and auxiliary activity to be conducted simultaneously and thus the critical path of a drilling function to be conducted through the moon pool 34 may be optimized. Alternatively, units are envisioned which will not be identical in size or even function, but are nevertheless capable of handling tubulars and passing tubulars back and forth between tubular advancing stations within a single derrick. Further, in a preferred embodiment, the multi-activity support structure is in the form of a four sided derrick. The subject invention, however, is intended to include other superstructure arrangements such as tripod assemblies or even two adjacent upright but interconnected frames and superstructures that are operable to perform a support function for more than one tubular drilling or activity for conducting simultaneous operations through the deck of a drillship, semi-submersible tension leg platform, or the like.

Method of Operation

Referring now specifically to FIGS. 9 through 22, there will be seen a sequence of operation of the subject multi-activity derrick and drillship wherein a first or main tubular advancing station is operable to conduct primary drilling activity and a second or auxiliary tubular advancing station is utilized for functions critical to the drilling process but can be advantageously removed from the drilling critical path to dramatically shorten overall drilling time.

Figure 9:
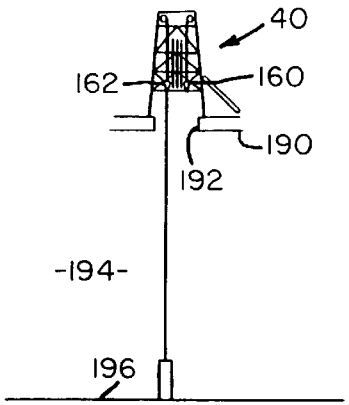

Turning specifically to FIG. 9, there is shown by a schematic cartoon a multi-activity derrick 40 positioned upon a drilling deck 190 of a drillship, semi-submersible, tension leg platform, or the like, of the type discussed above.

A moon pool opening in the drilling deck 192 enables tubulars such as risers, casing or drill pipe to be made up within the derrick 40 and extended through a body of water 194 to conduct drilling activity and/or activity associated with drilling within and upon the seabed 196.

The main drilling station 160 is utilized to pick up and make up a thirty inch jetting assembly for jetting into the seabed and twenty six inch drilling assemblies and places them within the derrick setback envelopes for the auxiliary station 162 to run inside of thirty inch casing. The main rig then proceeds to makeup eighteen and three fourths inch wellhead and stands it back in the derrick for the twenty inch tubular casing run.

At the same time the auxiliary station 162 is used to pick up the thirty inch casing and receives the jetting assembly from the main rig and runs the complete assembly to the seabed where it begins a thirty inch casing jetting operation.

Figure 10:
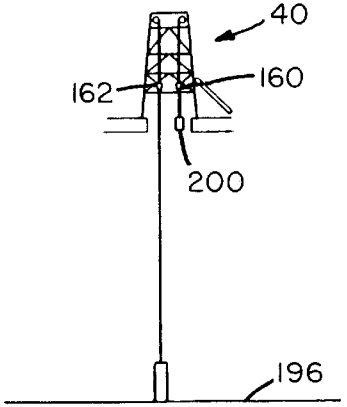

Referring to FIG. 10, the main rig skids a blowout preventer stack 200 under the rig floor and carries out a functioning test on the stack and its control system. At the same time the auxiliary rig and rotary station 162 are used to jet in and set the thirty inch casing. The auxiliary rig then disconnects the running tool from the wellhead and drills ahead the twenty six inch hole section.

Figure 11:
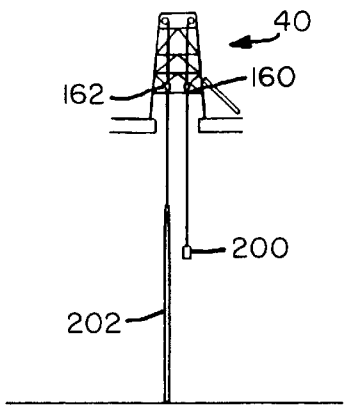

In FIG. 11 the main rig is utilized to start running the blowout preventer stack 200 and drilling riser to the seabed. Simultaneously the auxiliary rig, including second rotary station 162, is utilized to complete drilling of the twenty six inch hole section and then pulls the twenty six inch drilling assembly to the surface. The auxiliary station then rigs up and runs twenty inch tubular casing 202 and after landing the twenty inch casing in the wellhead the auxiliary rig then hooks up cement lines and cements the twenty inch casing in place. The auxiliary rig then retrieves the twenty inch casing landing string.

Figure 12:
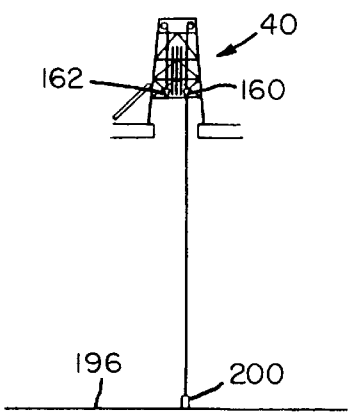

In FIG. 12 the main rig and rotary station 160 lands the blowout preventer 200 onto the wellhead and tests the wellhead connection. At the same time, the auxiliary rotary station 162 is utilized to lay down the thirty inch jetting and twenty six inch drilling assembly. After this operation is complete the auxiliary rotary station 162 is utilized to makeup a seventeen and one half inch bottom hole assembly and places the assembly in the derrick for the primary or main rotary assembly to pick up.

Figure 13:
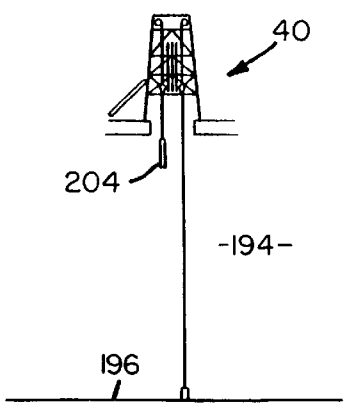

In FIG. 13 the main rotary assembly picks up the seventeen and one half inch hole section bottom hole assembly 204, which was previously made up by the auxiliary rig, and runs this and drillpipe in the hole to begin drilling the seventeen and one half inch section. At the same time, the auxiliary rotary station picks up single joints of thirteen and three eighths inch casing from the drillship pipe racks, makes them up into one hundred and twenty five foot lengths and then stands the lengths back in the derrick envelopes in preparation for the thirteen and three eighths inch casing run.

Figure 14:
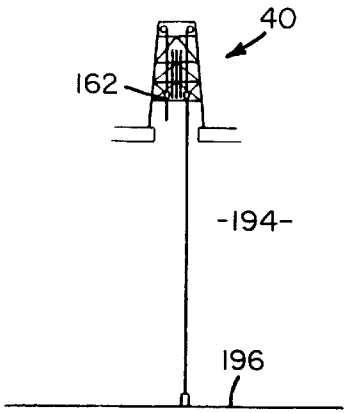

In FIG. 14 the main rotary station 160 completes drilling the seventeen and one half inch hole section. The drilling assembly is then retrieved back to the surface through the moon pool and the main rotary station then proceeds to rig up and run the thirteen and three eighths inch casing segments which were previously made up and set back within the derrick. After landing the casing in the wellhead, the rig cements the casing in place. At the same time the auxiliary rotary station 162 picks up single joints of nine and five eights inch casing from the drillship pipe racks, makes them up into triples and then stands them back in the derrick tubular handling envelopes in preparation for a nine and five eights inch casing run.

Figure 15:
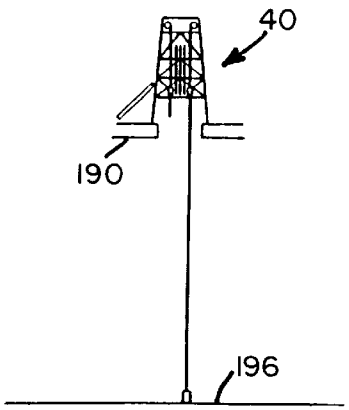

In FIG. 15 the primary rotary station tests the blowout preventer stack after setting the thirteen and three eighths inch seal assembly and the auxiliary rotary station changes the bottom hole assembly from seventeen and one half inches to twelve and one quarter inch assembly. The twelve and one quarter inch assembly is then set back in the derrick conduit handling envelopes in a position where they can be picked up by the main rotary station.

Figure 16:
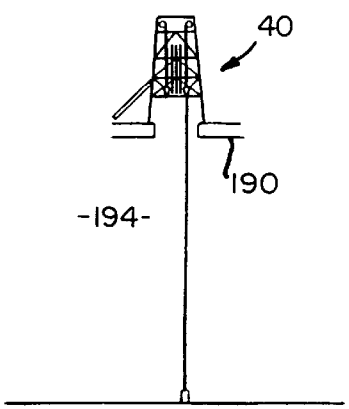

In FIG. 16 the primary rotary station 160 is used to run in the hole with twelve and one quarter inch bottom hole assembly and begins drilling the twelve and one quarter inch hole section. At the same time the auxiliary rotary station is utilized to make up nine and five eights inch casing running tool and cement head and then stands both of these complete assemblies back in the conduit handling envelopes of the derrick in preparation for a nine and five eights inch casing run.

Figure 17:
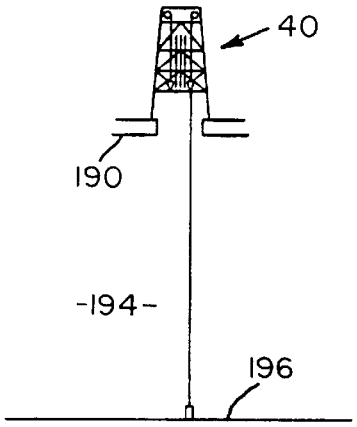

In FIG. 17 the primary rotary station 160 is utilized to complete drilling the twelve and one quarter inch hole section and retrieves the twelve and one quarter inch assembly back to the surface. The primary rotary station then rigs up and runs the nine and five eigths inch casing in the hole and cements the casing in place. At the same time the auxiliary rotary station changes the bottom hole assembly from twelve and one quarter inch to eight and one half-inch and stands the eight and one half-inch assemblies back in the derrick to be picked up by the primary rotary station.

Figure 18:
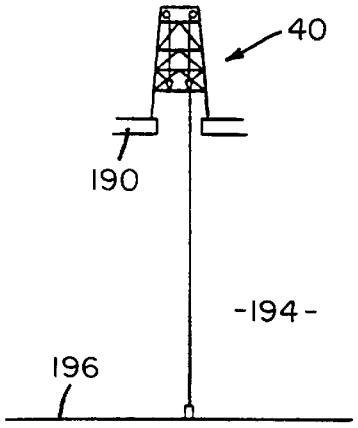

In FIG. 18 the primary rotary station is shown running in the hole with eight and one half-inch drilling assemblies and begins to drill the eight and one half-inch hole with the first rotary top drive. During this operation the auxiliary rotary station is used to make up a casing cutter.

Figure 19:
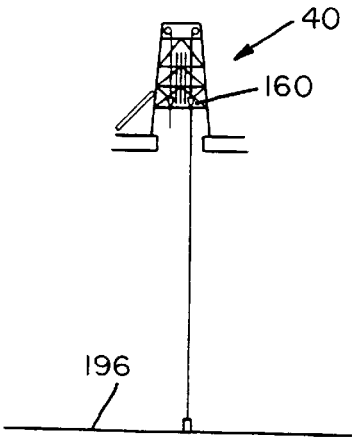

In FIG. 19 the primary rotary station 160 completes drilling the eight and one quarter inch hole section and retrieves the drilling assembly back to the surface. The primary rotary station then proceeds to rig down the riser and begins to recover the blowout preventer stack 200.

Figure 20:
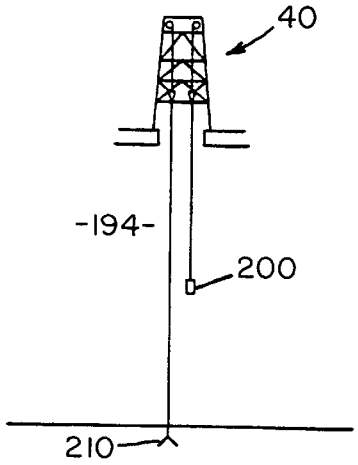

As shown in FIG. 20, once the blowout preventer 200 is clear of the wellhead, the auxiliary rotary station runs in the hole with a casing cutter 210 and cuts the casing.

Figure 21:
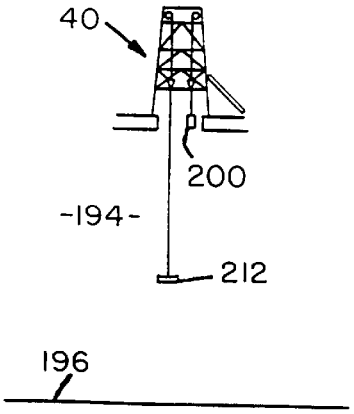

In FIG. 21 the primary rotary station 160 is used to continue recovering the blowout preventer stack 200 and the auxiliary rotary station is used to recover the wellhead 212.

In FIG. 22 the primary rotary station prepares for moving the driliship and the auxiliary rotary station assists in that operation.

COMPARATIVE ANALYSIS

Referring now specifically to FIG. 23*a*, there will be seen an illustrative time chart of typical drilling activity for an offshore well in accordance with a conventional drilling operation. The filled in horizontal bars represent time frames along an abscissa and tubular activity is shown along an ordinate. As an initial operation, eight hours, note bar 220, are utilized to pick up pipe and twenty seven hours, note bar 222, are then required to jet drill thirty inch casing in place. Three hours are then used to make up and lay down bottom hole assemblies and running tools, see bar 224. Next, forty four and one half hours, note bar 226, are required to drill and cement twenty inch casing. Sixty-nine hours 228 are necessary to run and test a blowout preventer. Three hours are required to make up and lay down bottom hole assemblies and running tools, see time bar 230 Next, in sequence thirty nine hours, note bar 234, and twenty one hours, note bar 236, are used to run and cement thirteen and three eighths inch casing. Four and three quarter hours are used to make up and lay down bottom hole assemblies and running tools, note bar 238, and ten and one half hours are used to test the blowout preventer, note bar 240. Next, eighty one and one half hours, note bar 242, are utilized to drill twelve and one quarter inch drill string and twenty two hours are used to run and cement nine and five eights inch casing, note bar 244. Two and three quarter hours are then necessary to make up and lay down bottom hole assemblies and running tools, note bar 246, and fourteen hours, note bar 248, are utilized to drill eight and one half-inch hole. Next, thirty and one half hours are spent recovering the blowout preventer, note bar 250, seventeen hours are used to run up and recover the wellhead, as depicted by time bar 252, and finally the drill pipe is laid down requiring eight hours, see time bar 254.

In contrast to a conventional drilling sequence, an identical drilling operation is depicted by a time chart in FIG. 23*b* in accordance with the subject invention, where a main and auxiliary tubular station are simultaneously utilized in a preferred embodiment of the subject invention, to dramatically decrease the overall drilling time and thus increase efficiency of the drilling operation. More specifically, it will be seen that the main drilling operation can be conducted through a first tubular advancing station and the critical path of the drilling sequence is depicted with solid time bars whereas auxiliary activity through a second tubular advancing station is shown by crossed hatched time bars.

Initially eight and one half hours are utilized by the primary rotary station to rig up a bottom hole assembly and pick up pipe, note time bar 260. Next, the blowout preventer is skidded to position and tested which utilizes twelve hours, as shown by time bar 262. Forty two hours are then required to run the blowout preventer to the seabed as shown by time bar 264 and 15 hours, as shown by time bar 266, are used to land and test the blowout preventer. Next, the seventeen and one half inch hole is drilled by the primary rotary station and rotary table 160 for 39 hours as depicted by time bar 268. Subsequently, the thirteen and three eighths inch casing is run and cemented in place utilizing fourteen hours as depicted by time bar 270.

The next operation requires ten and one half hours to test the blowout preventer as shown by time bar 272. Eighty one and one half hours are used by the primary rotary station and rotary table 160 to drill the twelve and one quarter inch hole as depicted by time bar 274. Time bar 276 discloses sixteen hours to run and cement the nine and five eighths inch casing. An eight and one half inch drill hole then consumes fourteen hours as depicted by time bar 278 and finally the main rig utilizes thirty and one half hours as depicted by time bar 280 to recover the blowout preventer.

During this same time sequence the second or auxiliary tubular advancing station 162 is used to jet drill the thirty inch casing in twenty one and one half hours as shown by hashed time bar 282. Then the twenty inch casing is drilled and run during a period of forty four and one half hours as shown by time bar 284. The auxiliary rig is then used for five hours to make up and lay down bottom hole assemblies and running tools for five hours as shown by time bar 286. Eight and one half hours are used to set back thirteen and three eighths inch doubles as shown in time bar 288. Time bar 290 illustrates the use of four and one quarter hours to make up and lay down bottom hole assemblies and running tools, and ten hours are required, as shown in time bar 292, to set back nine and five eights inch doubles. Four hours are then required as shown by time bar 300 to make up and lay down bottom hole assemblies and running tools and then nine and one half hours are used to make up and run a casing cutter as depicted by time bar 302. The wellhead is then recovered in six and one half hours as shown on time bar 304 and finally eight hours are utilized as depicted in time frame 206 to lay down the drill string.

By comparing the identical sequence of events from a conventional drilling operation to the subject multi-activity drilling method and apparatus, it will be appreciated that the critical path has been substantially reduced. In this particular example of exploration drilling activity, the time saving comprises twenty nine percent reduction in time for a drilling operation. In other instances, and depending upon the depth of the water, this time sequence could be longer or shorter, but it will be appreciated by those of ordinary skill in the art that as the depth of water increases, the advantage of a multi-activity drilling method and apparatus in accordance with the subject invention increases.

The above example is illustrated with respect to an exploration drilling program. Developmental drilling actively may be required which would involve twenty or more wells. In this event, the subject invention can advantageously conduct multiple well developmental drilling activity, or work over activity, simultaneously on multiple wells, and again dramatically reduce the amount of time the drillship will be required to stay on site.

SUMMARY OF MAJOR ADVANTAGES OF THE INVENTION

After reading and understanding the foregoing description of preferred embodiments of the invention, in conjunction with the illustrative drawings, it will be appreciated that several distinct advantages of the subject multi-activity drilling method and apparatus are obtained.

Without attempting to set forth all of the desirable features and advantages of the instant method and apparatus, at least some of the major advantages of the invention are depicted by a comparison of FIG. 23*a* and FIG. 23*b* which visually illustrates the dramatic enhancement in efficiency of the subject invention. As noted above, even greater time efficiencies will be realized in developmental drilling or well remedial works over activity.

The enhanced drilling time, and thus cost savings, is provided by the multi-activity derrick having substantially identical tubular advancing stations wherein primary drilling activity can be conducted within the derrick and auxiliary activity concomitantly conducted from the same derrick and through the same moon pool.

The derrick includes dual rotary stations, and in a preferred embodiment top drives and a dual tubular handling system. A plurality of tubular set back envelopes are positioned adjacent the dual rotary station and first and second conduit handling assemblies operably transfer riser segments, casing, and drillpipe assemblies between the first and second tubular advancing stations and any of the set back envelopes. The dual derrick drawworks are independently controlled by substantially identical drill consoles mounted upon the drilling floor of the derrick such that independent operations can be performed simultaneously by a main drilling rotary station through a moon pool while auxiliary operations can be simultaneously conducted through a second rotary station and the moon pool.

The multi-station derrick enables a driller to move many rotary operations out of the critical path such as blowout prevention and riser running while drilling a top hole; making up bottom hole assemblies or running tools with an auxiliary rotary while drilling with a primary rotary station; making up and standing back casing with the auxiliary rotary while drilling with the primary rotary assembly; test running; measurements while drilling while continuing primary drilling activity; and deploying a high-pressure second stack/riser outside of primary rig time. Still further, the subject invention permits an operator to rig up to run trees with the auxiliary rotary station while carrying out normal operations with a primary rotary station; running a subsea tree to the bottom with the auxiliary rotary station while completing riser operations and simultaneously running two subsea trees, bases, etc.

In describing the invention, reference has been made to preferred embodiments and illustrative advantages of the invention. In particular, a large, tanker dimension drillship 30 has been specifically illustrated and discussed which is the presently envisioned preferred embodiment. It will be appreciated, however, by those of ordinary skill in the art, that the subject single derrick with multi-rotary structure may be advantageously utilized by other offshore platform systems such as jack-ups, semi-submersibles, tension leg platforms, fixed towers, and the like, without departing from the subject invention. Those skilled in the art, and familiar with the instant disclosure of the subject invention, may also recognize other additions, deletions, modifications, substitutions, and/or other changes which will fall within the purview of the subject invention and claims.

What is claimed is:

1. A multi-activity drilling assembly mounted above an opening of a drillship, semi-submersible, tension leg platform, jack-up platform, or offshore tower and being operable to be positioned above the surface of a body of water for supporting drilling operations through a drilling deck and into the bed of the body of water, said multi-activity drilling assembly including:

a derrick positioned above the opening and extending above the drilling deck for simultaneously supporting drilling operations and operations auxiliary to drilling operations through the drilling deck;

a first means connected to said derrick for advancing tubular members through the drilling deck and into the bed of the body of water;

first means, connected to said derrick, for handling tubular members as said tubular members are advanced through the drilling deck by said first means for advancing;

second means connected to said derrick for advancing tubular members through the drilling deck and into a body of water to the seabed; and second means, connected to said derrick, for handling tubular members as said tubular members are advanced through the drilling deck by said second means for advancing for conducting operations auxiliary to said drilling operations; and means positioned within said derrick for transferring tubular assemblies between said first means for advancing tubular members and said second means for advancing tubular members to facilitate simultaneous drilling operations and operations auxiliary to said drilling operations, wherein drilling activity can be conducted from said derrick by said first means for advancing and said first means for handling tubular members and auxiliary drilling activity can be simultaneously conducted from said derrick by said second means for advancing and said second means for handling tubular members.

2. A multi-activity drilling assembly as defined in claim 1 wherein said first and second means for advancing tubular members comprises:

a first and second top drive assembly positioned within said derrick.

3. A multi-activity drilling assembly as defined in claim 1 wherein said first and second means for advancing tubular members comprises:

a first and second rotary table positioned within said derrick.

4. A multi-activity drilling assembly as defined in claim 3 wherein:

said first rotary table and second rotary table being spaced within the periphery of said derrick.

5. A multi-activity drilling assembly as defined in claim 1 wherein said means for transferring includes:

a rail assembly operably extending between a position adjacent to said first means for advancing tubular members and a position adjacent to said second means for advancing tubular members;

said first means for handling tubular members being mounted to traverse upon said rail wherein conduit assemblies may be operably transferred between said first means for advancing tubular members and said second means for advancing tubular members to facilitate simultaneous drilling operations and operations auxiliary to said drilling operations.

6. A multi-activity drilling assembly as defined in claim 1 and further including:

a first driller's console operable to control said first means for advancing tubular members; and a second driller's console substantially similar to said first driller's console and being operable to independently control said second means for advancing tubular members.

7. A multi-activity drilling assembly as defined in claim 1 and further including:

a first tubular setback envelope positioned adjacent to said first means-for advancing tubular members; and a second tubular setback envelope positioned adjacent to said second means for advancing tubular members.

8. A multi-activity drilling assembly as defined in claim 7 and further including:

a third tubular setback envelope positioned between said first tubular setback envelope and said second tubular setback envelope.

9. multi-activity drilling assembly as defined in claim 7 and further including:

a tubular handling system for transferring tubular members between said first tubular setback envelope and said second tubular setback envelope and said first means for advancing tubular members and said second means for advancing tubular members.

10. A multi-activity drilling assembly operable to be supported from a position above the surface of a body of water for conducting drilling operations into the bed of the body of water, said multi-activity drilling assembly including:

a drilling superstructure operable to be mounted upon a drilling deck for simultaneously supporting drilling operations for a well and operations auxiliary to drilling operations for the well;

first means connected to said drilling superstructure for advancing tubular members into the bed of body of water;

second means connected to said drilling superstructure for advancing tubular members simultaneously with said first means into the body of water to the seabed, and means positioned adjacent to said first and second means for advancing tubular members for transferring tubular assemblies between said first means for advancing tubular members and said second means for advancing tubular members to facilitate simultaneous drilling operations auxiliary to said drilling operations, wherein drilling activity can be conducted for the well from said drilling superstructure by said first means for advancing tubular members and auxiliary drilling activity can be simultaneously conducted for the well from said drilling superstructure by said second means for advancing tubular members.

11. A multi-activity drilling assembly as defined in claim 10 and further including:

a first tubular setback station positioned adjacent to said first means for advancing tubular members; and a second tubular setback station positioned adjacent to said second means for advancing tubular members.

12. A multi-activity drilling assembly as defined in claim 10 wherein said first and second means for advancing tubular members comprises:

a first and second top drive assembly connected to said drilling superstructure.

13. A multi-activity drilling assembly as defined in claim 10 wherein said first and second means for advancing tubular members comprises:

a first and second rotary table positioned adjacent to said drilling superstructure for assisting in performing drilling operations and for simultaneously assisting in performing operations auxiliary to drilling operations through the drilling deck.

* * * * *

UNITED STATES PATENT AND TRADEMARK OFFICE

CERTIFICATE OF CORRECTION

PATENT NO. : 6,085,851
DATED : July 11, 2000
INVENTOR(S) : Scott et al.

It is certified that error appears in the above-identified patent and that said Letters Patent is hereby corrected as shown below:

Title page,
Illustrative Figure, the reference numeral “46” should read -- 42 --.

Drawings,
Sheet 1, Fig. 1, the reference numeral “46” should read -- 42 --.
Sheet 3, Fig. 5, the reference numeral “182” should read -- 183 --.
Sheet 3, Fig. 5, the reference numeral “183” should read -- 182 --.
Sheet 4, Fig. 6, the reference numeral “140” should read -- 142 --.
Sheet 4, Fig. 6, the reference numeral “156” should read -- 158 --.
Sheet 5, Fig. 7, the reference numeral “182” should read -- 181 --.

Column 1,
Line 3, “DRILL” should read -- DRILLING --.
Line 53, between “site” and “legs” insert -- , --.

Column 2,
Lines 11, 13 and 21, delete “U.S.” (second occurrence).
Line 19, between “legs” and “against” insert -- , --.
Line 30, “amid ships” should read -- amidships --.

Column 4,
Line 30, delete “FIG.” should read -- FIGS. --.
Line 52, delete “is” (first occurrence).
Line 55, after “above” delete “a” insert -- the --.
Line 55, after “and” insert -- is --.

Column 5,
Line 19, “sack” should read -- stack --.
Line 50, after “77” delete “,” insert -- . --.
Line 67, after “runway” delete “101”.

Column 6,
Line 29, “terminate” should read -- terminates --.
Line 40, “140” should read -- 142 --.
Line 62, after “tubular” insert -- advancing station --.
Line 64, “advanced” should read -- advancing --.

UNITED STATES PATENT AND TRADEMARK OFFICE

CERTIFICATE OF CORRECTION

PATENT NO. : 6,085,851
DATED : July 11, 2000
INVENTOR(S) : Scott et al.

It is certified that error appears in the above-identified patent and that said Letters Patent is hereby corrected as shown below:

Column 7,
Line 66, delete “of”.

Column 9,
Lines 32 and 35, “eights” should read -- eighths --.
Lines 48 and 51, “eights” should read -- eighths --.
Line 57, “eights” should read -- eighths --.

Column 10,
Line 9, delete “160”.
Line 25, between “see” and “bar” insert -- time --.
Line 30, after “230” insert -- . --.
Line 39, “eigths” should read -- eighths --.

Column 11,
Line 30, “eights” should read -- eighths --.

Column 13,
Line 40, between “being” and “spaced” insert -- mutually --.

Signed and Sealed this

Eleventh Day of March, 2003

JAMES E. ROGAN
*Director of the United States Patent and Trademark Office*